United States Patent [19]

Anderson et al.

[11] Patent Number: 4,487,192

[45] Date of Patent: Dec. 11, 1984

[54] PLASMA JET IGNITION SYSTEM

[76] Inventors: Richard W. Anderson, 410 Huntington Pl., Ann Arbor, Mich. 48104; Joseph R. Asik, 776 Great Oaks Dr., Bloomfield Hills, Mich. 48013

[21] Appl. No.: 485,985

[22] Filed: Apr. 18, 1983

[51] Int. Cl.[3] ..... F02P 1/00

[52] U.S. Cl. ..... 123/654; 313/123; 313/118; 313/140; 123/620; 123/143 B

[58] Field of Search ..... 123/169 PH, 169 PA, 123/620, 143 B, 654, 169 R; 313/118, 120, 140, 141, 123

[56] References Cited

U.S. PATENT DOCUMENTS

| | | | |
|---|---|---|---|
| 703,759 | 7/1902 | Brown | 123/169 PH |
| 2,985,797 | 5/1961 | Williams et al. | 123/654 |
| 3,032,683 | 5/1962 | Ruckelshaus | 123/654 |
| 3,521,105 | 7/1970 | Franks . | |
| 3,567,987 | 3/1971 | Schnurmacher | 313/123 |
| 3,842,818 | 10/1974 | Cowell et al. . | |
| 3,842,819 | 10/1974 | Atkins et al. . | |
| 3,900,017 | 8/1975 | Collins | 123/654 |
| 3,911,307 | 10/1975 | Sawada . | |
| 4,020,388 | 4/1977 | Pratt | 123/169 MG |
| 4,122,816 | 10/1978 | Fitzgerald | 123/620 |
| 4,317,068 | 2/1982 | Ward | 123/654 |

FOREIGN PATENT DOCUMENTS

| | | | |
|---|---|---|---|
| 18622 | 12/1980 | European Pat. Off. . | |
| 1902199 | 1/1969 | Fed. Rep. of Germany | 123/169 G |

OTHER PUBLICATIONS

Society of Automotive Engineers', Paper No. 770355, 1977, entitled "Design of a Plasma Jet Ignition System for Automotive Application", by J. R. Asik et al.

*Primary Examiner*—Ronald B. Cox

[57] ABSTRACT

An ignition system for an internal combustion engine having a capacitive plasma jet plug including a capacitor in parallel with the series combination of an auxiliary gap and a plasma cavity. The auxiliary gap increases the required breakdown voltage before the plasma cavity generates a spark and obtains supplemental energy from the energy stored in the capacitor.

2 Claims, 2 Drawing Figures

PLASMA JET IGNITION SYSTEM

BACKGROUND OF THE INVENTION

1. Field of the Invention

This invention relates to ignition devices, particularly for internal combustion engines.

2. Prior Art

Operating a spark ignited internal combustion engine so as to achieve lower inherent engine emissions tends to approach the limits of the capability of conventional ignition sources to avoid misfire when using a lean air/fuel ratio and to tolerate an increased amount of exhaust gas recirculation. Therefore there has been interest in developing new ignition sources and determining their effects on engine performance and emissions.

Among the high energy ignition systems investigated is plasma jet ignition. Such a system is described in Society of Automotive Engineer' Paper No. 770355, 1977 entitled "Design of a Plasma Jet Ignition System for Automotive Application" by J. R. Asik, P. Piatkowski, M. J. Foucher and W. G. Rado. A plasma jet spark plug has a plasma jet cavity which can produce spark energy. If a sufficient amount of electrical energy is delivered to the plasma cavity in a short enough period of time, a plasma torch or a jet is generated that protrudes momentarily out of the end of the cavity. This plasma consists of free electrons and ions that are at a high temperature (10,000° to 30,000° K.) and are therefore highly energetic and chemically active.

The plasma is produced by the instantaneous heating of the gas confined in the cavity by the electrical energy. This raises the temperature of the confined gas and produces partial ionization of this gas. The sudden increase in temperature also raises the instantaneous pressure of the partially confined plasma, causing a portion of it to be ejected out of the end of the cavity. There are many factors that can influence the operation of the plasma jet plug. Some of these factors are the amount of applied electrical energy, the rate of energy delivery, the volume of the cavity, the cavity dimensions, the cavity orifice size, the ambient gas pressure, and the quantity of fuel present in the cavity. Among the parameters that characterize the plasma jet are the length and diameter of the luminous region or plume, the turbulence generated by the jet, and the instantaneous temperature profile of the jet.

U.S. Pat. No. 3,521,105 to Franks discloses an ignition device with planar, parallel electrodes. A pulse of ionizable gas is passed between the electrodes which are energized by a high-voltage power supply. The ionized gas is injected into the combustion chamber of an internal combustion engine to cause the air/fuel mixture to ignite.

U.S. Pat. No. 3,842,818 to Cowell et al discloses a plasma jet ignition device for an internal combustion engine. The device generates a plasma flame and employes two voltage sources. The higher voltage causes electrical breakdown across a spark gap so that the lower voltage source can discharge across the gap.

U.S. Pat. No. 3,842,819 to Atkins et al also discloses a plasma jet ignition device which employs two voltage sources.

U.S. Pat. No. 3,911,307 to Goto et al discloses a spark plug which generates and injects a plasma-like gas into the air/fuel mixture in an internal combustion engine.

However, much of this earlier work on a plasma jet ignition system has shortcomings such as high electrode erosion, high radio frequency interference, possible electrical shock hazard, and an estimated high system cost. These are some of the problems this invention overcomes.

SUMMARY OF THE INVENTION

This invention provides an ignition system which improves performance during lean air/fuel ratio operation and reduces cycle to cycle variation of peak combustion pressure in a cylinder. Such cycle to cycle variation is typically caused by flames growing at different rates or by flames beginning with different sizes.

In accordance with an embodiment of this invention, an ignition system uses a capacitive plasma jet plug. The plasma jet plug has a plasma cavity for generating an ignition spark and a capacitor connected in parallel with the plasma cavity. The capacitor provides increased energy for the spark event when voltage breakdown occurs in the plasma cavity. In one embodiment of this invention an auxiliary gap is positioned electrically in series with the plasma cavity to increase the required breakdown voltage before the plasma cavity generates the spark. The capacitor then is connected in parallel with the series combination of the plasma cavity and the auxiliary gap. The capacitor discharges and increases the energy for the spark event only when the breakdown voltage for the auxiliary gap has been reached.

DETAILED DESCRIPTION OF THE INVENTION

Figure 1:
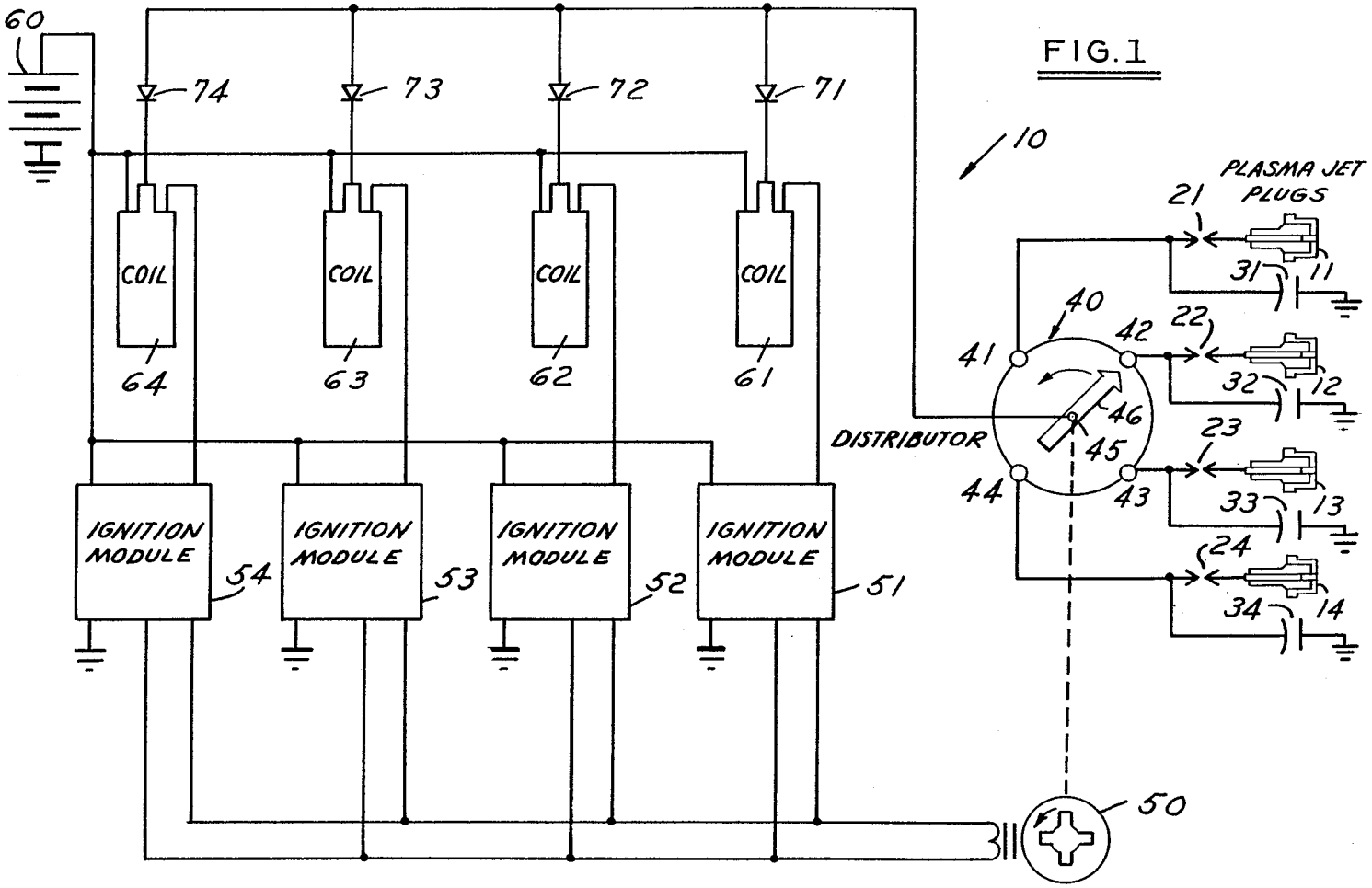
FIG. 1 is a schematic diagram of an ignition system in accordance with an embodiment of this invention including a plasma jet plug with a plasma cavity, an auxiliary gap, and a parallel capacitor.

Referring to FIG. 1, an ignition system 10 includes plasma jet plugs 11, 12, 13 and 14. Associated with each plasma jet plug, in series with a plasma cavity in the plasma jet plug, is an auxiliary gap and, electrically in parallel with the auxiliary gap and the plasma cavity, a capacitor. Auxiliary gaps 21, 22, 23 and 24 and capacitors 31, 32, 33 and 34 are associated in such a manner with plasma jet plugs 11, 12, 13 and 14, respectively. A distributor 40 has electrodes 41, 42, 43 and 44 associated with plasma jet plugs 11, 12, 13 and 14, respectively. A central electrode 45 is coupled to a rotor 46 for delivery of an ignition energy pulse. A crankshaft ignition sensor 50 is inductively coupled to provide a signal to ignition modules 51, 52, 53 and 54 to interrupt primary current in coils 61, 62, 63 and 64, respectively, thereby generating a secondary spark current which is applied to distributor 40 through diodes 71, 72, 73 and 74, respectively. A battery 60 is connected to ignition coils 61 through 64 and ignition modules 51 through 54.

Figure 2:
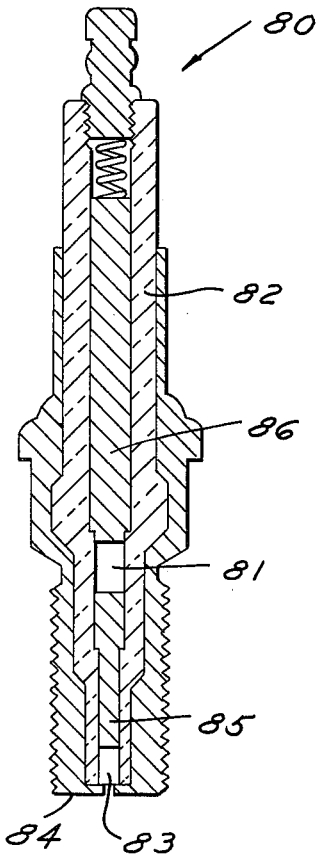
FIG. 2 is a cross section drawing of a capacitor plasma jet plug in accordance with an embodiment of this invention including integral plasma cavity, auxiliary gap and capacitor.

Referring to FIG. 2, a plasma jet plug 80 includes an integral auxiliary gap 81 and an integral capacitor 82 including a dielectric material between two conductive members. Advantageously, one conductive member is an electrode 86 receiving spark energy applied to plasma jet plug 80 and the other conductive member is a ground electrode 84 coupling a ground reference potential to plasma jet plug 80. The dielectric material extends axially and has an elongated, generally tubular configuration. A plasma cavity 83 is positioned between ground electrode 84 and an electrode 85. Auxiliary gap 81 is positioned between electrode 85 and electrode 86 connected to an energy delivery system. When the voltage applied to plasma jet plug 80 is sufficient to breakdown auxiliary gap 81 so that conduction can occur, capacitor 82 can discharge and supply additional current through auxiliary gap 81 to the plasma cavity 83 to increase spark energy.

In operation, plasma jet plug 80 is capable of providing a more intense and more energetic spark kernel having greater physical extension. This larger kernel improves the magnitude of combustion chamber pressure with respect to time and with respect to crankshaft angle thereby providing a more predictable or smoother application of power by the combustion chamber.

The energy to be supplied by the energy delivery system is equal to one-half $CV^2$, wherein C is the magnitude of the capacitance, typically about 50–500 pico farads, and V is the voltage across the auxiliary gap, typically about 20 kilovolts. As a result, the energy to be supplied is about 100 millijoules. It may be advantageous to have a slightly higher energy such as 450 millijoules which would then require a capacitor of about 1000 pico farads and a voltage of about 30 kilovolts. In the embodiment of FIG. 1, all of the ignition coils fire simultaneously and are in parallel to provide an increased charging energy. Advantageously, to reduce costs, a single large coil with a larger power transistor and a single electronic module can be used. Advantageously, also, the capacitors are of a high voltage, low inductance and low resistance design.

The addition of parallel capacitors 31, 32, 33 and 34 increases the plasma jet plug capacitance from a nominal value from about 10 pico farads to about 500 pico farads or more. By doing this, the breakdown mode discharge energy of the plug is increased from about two millijoules (using the $\frac{1}{2}$ $CV^2$ formula) to a value of about 100 millijoules, assuming a breakdown voltage of 20 kilovolts in both cases. The delivery of energy at a level of about 100 millijoules is sufficient to produce plasma jet action in a plasma jet plug. Since the typical inductance and resistance of the discharge circuit consisting of the capacitor and the plasma plug can be made negligible, the duration of discharge is estimated to be very small—about 10 to 100 nanoseconds. That is, a 10 to 100 $10^{-9}$ second spark discharge initiates the creation of the plasma jet.

Accordingly, there will be plasma jet operation in the breakdown mode of a spark event, in contrast to plasma jet operation just in the sustaining mode of a spark event. Breakdown mode occurs during the time interval from the initiation of a spark at a relatively high voltage until the start of the sustaining mode when the spark is maintained at a substantially lower sustaining voltage. It is believed that electrode erosion is minimal during breakdown mode operation. Electrode erosion would be higher if plasma jet operation began, not during breakdown mode, but only in the sustaining mode of a spark event by the addition of additional energy during the sustaining mode. Further, it is also possible to use known standard radio suppression techniques, such as resistance/inductance cable and silicone grease on the rotor tip. Since the impulsive discharge current is confined to the plasma plug circuit itself, the radio frequency interference consequences of the impulsive current can be minimized.

Various modifications and variations will no doubt occur to those skilled in the various arts to which this invention pertains. For example, the construction of the energy delivery system can be varied from that disclosed herein. These and all other variations which basically rely on the teachings through which this disclosure has advanced the art are properly considered within the scope of this invention.

We claim:

1. An ignition system for an internal combustion engine having a capacitive plasma jet plug means associated with an energy delivery system, said plug means including:

a plasma cavity coupled to the energy delivery system for generating an ignition spark;

a capacitor connected in parallel with said plasma cavity and to the energy delivery system for receiving energy so that when the breakdown voltage of said plasma cavity is reached additional energy from said capacitor is supplied to said plasma cavity to form a plasma jet;

an auxiliary gap in series with said plasma cavity to increase the required breakdown voltage before said plasma cavity generates a spark;

said capacitor being connected in parallel with the series combination of said plasma cavity and said auxiliary gap for receiving a charge from an ignition module to provide for increased energy for the spark event when breakdown occurs in said auxiliary gap;

said capacitive plasma jet plug means being integrally formed to include said auxiliary gap, said plasma cavity and said capacitor;

said energy delivery system being adapted to provide at least 100 millijoules of energy and including a distributor having secondary contacts coupled to said plasma jet plug means for providing spark energy and a primary contact for receiving spark energy; and an ignition means coupled to said primary contact, said ignition means including a plurality of ignition coils connected in parallel and each ignition coil coupled to an ignition module so that said ignition coils are activated simultaneously to provide an increased charging energy.

2. An ignition system as recited in claim 1 wherein there are the same number of each of said plasma jet plug means, said ignition coils and said ignition modules.

* * * * *

UNITED STATES PATENT AND TRADEMARK OFFICE

CERTIFICATE OF CORRECTION

PATENT NO. : 4,487,192

DATED : December 11, 1984

INVENTOR(S) : Richard W. Anderson and Joseph R. Asik

It is certified that error appears in the above-identified patent and that said Letters Patent is hereby corrected as shown below:

On the title page insert; --[73] Assignee: Ford Motor Company, Dearborn, Michigan--.

--Attorney, Agent, or Firm-Peter Abolins; Robert D. Sanborn--.

Signed and Sealed this

*Third* Day of *September 1985*

[SEAL]

*Attest:*

DONALD J. QUIGG

*Attesting Officer* *Acting Commissioner of Patents and Trademarks - Designate*